US011220113B2

(12) United States Patent
Montagutelli

(10) Patent No.: US 11,220,113 B2
(45) Date of Patent: Jan. 11, 2022

(54) COMPACT THERMAL PRINTING MECHANISM

(71) Applicant: APS TRADING OOD, Botevgrad (BG)

(72) Inventor: Denis Montagutelli, Angers (FR)

(73) Assignee: APS TRADING OOD, Botevgrad (BG)

( * ) Notice: Subject to any disclaimer, the term of this patent is extended or adjusted under 35 U.S.C. 154(b) by 0 days.

(21) Appl. No.: 17/042,554

(22) PCT Filed: Apr. 12, 2019

(86) PCT No.: PCT/EP2019/059508
§ 371 (c)(1),
(2) Date: Sep. 28, 2020

(87) PCT Pub. No.: WO2019/214902
PCT Pub. Date: Nov. 14, 2019

(65) Prior Publication Data

US 2021/0031539 A1 Feb. 4, 2021

(30) Foreign Application Priority Data

May 8, 2018 (EP) ..... 18171293

(51) Int. Cl.
*B41J 25/34* (2006.01)
*B41J 2/33* (2006.01)
(Continued)

(52) U.S. Cl.
CPC ..... *B41J 2/33* (2013.01); *B41J 2/3352* (2013.01); *B41J 25/34* (2013.01); *B41J 29/02* (2013.01); *B41J 29/38* (2013.01); *B41J 2202/31* (2013.01)

(58) Field of Classification Search
CPC ... B41J 25/34; B41J 2/33; B41J 2/3352; B41J 29/02; B41J 29/38; B41J 2202/31; B41J 2/32; B41J 2/165; B41J 11/04
See application file for complete search history.

(56) References Cited

U.S. PATENT DOCUMENTS

2007/0291098 A1* 12/2007 Sawai ..... B41J 2/325 347/198
2018/0126748 A1* 5/2018 Montagutelli ..... B41J 11/04

FOREIGN PATENT DOCUMENTS

EP 1133146 A1 9/2001
EP 1719628 A1 11/2006
(Continued)

OTHER PUBLICATIONS

International Search Report for Application No. PCT/EP2019/059508, dated Jul. 3, 2019.

*Primary Examiner* — Huan H Tran
(74) *Attorney, Agent, or Firm* — Marshall, Gerstein & Borun LLP

(57) ABSTRACT

The compact thermal printing mechanism according to the invention is applicable for handheld payment terminals. The invention provides a printer chassis (1) with reinforced flat area (20) by at least one reinforcing element comprising a fold of the printer chassis (1). This folded portion of the printer chassis strengthens the chassis and provides a very strong resistance to bending forces of the lateral pressure means (18) of the platen roller (6). The stable and uniform pressure distribution across the paper width ensures uniform print quality.

12 Claims, 4 Drawing Sheets

(51) Int. Cl.

| | |
|---|---|
| ***B41J 2/335*** | (2006.01) |
| ***B41J 29/02*** | (2006.01) |
| ***B41J 29/38*** | (2006.01) |

(56) References Cited

FOREIGN PATENT DOCUMENTS

| | | | |
|---|---|---|---|
| EP | 3095608 | A1 | 11/2016 |
| JP | 2001/253586 | A | 9/2001 |

* cited by examiner

FIGURE 1
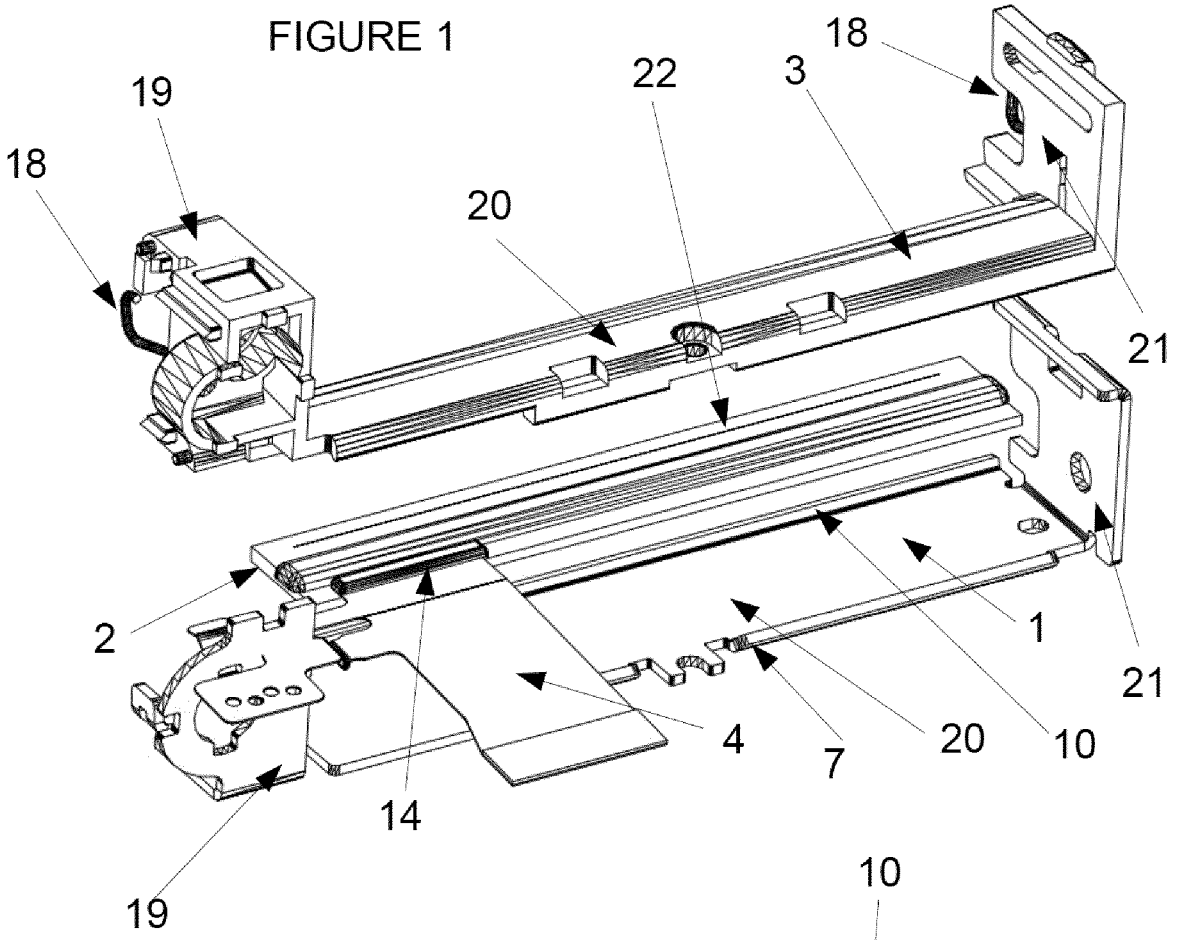
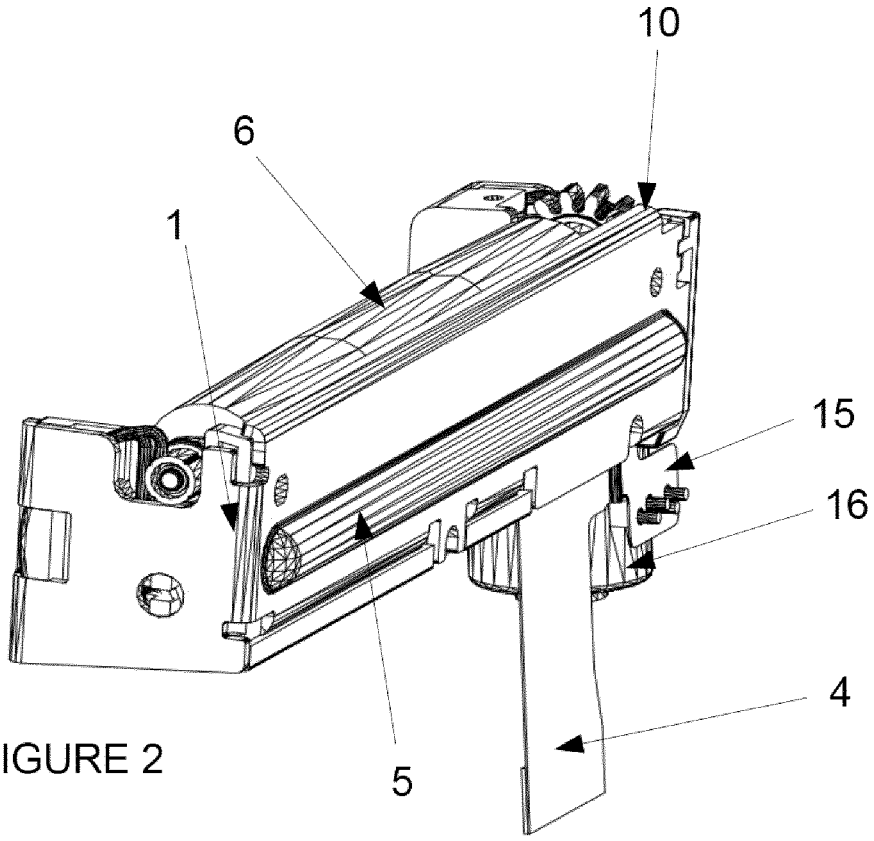
FIGURE 2

COMPACT THERMAL PRINTING MECHANISM

CROSS-REFERENCE TO RELATED APPLICATION

This present application is the US national phase of International Patent Application No. PCT/EP2019/059508, filed Apr. 12, 2019, which claims priority to European Application No. 18171293.6, filed May 8, 2018. The priority application, EP 18171293.6, is hereby incorporated by reference in its entirety.

TECHNICAL FIELD OF THE INVENTION

The present invention is in the field of the thermal printing mechanisms, such as thermal printers. They are widely used for handheld payment terminals where compactness and cost are the main factors of improvements.

PRIOR ART

A thermal printing mechanism is usually composed of the following elements: thermal printhead, which is made of a ceramic substrate, having a rectangle shape with the width of the paper to be printed on, and a plurality of thermal dots installed on the ceramic substrate; a platen roller, to drive a thermally sensitive paper against said thermal dotline, said platen roller being driven in rotation through a gearing system by a motor, which is in the most cases is a stepper motor, plus urging means to create compression on the thermal paper between the thermal printhead and the platen roller.

All the above-mentioned elements are held directly by a chassis on which can be mounted intermediary holding parts that are integral to the chassis, said chassis being a plastic molded frame of a folded metal sheet. In most of the cases, the thermal printhead is mounted on a thermal head support, which is rotatively hinged onto the chassis, and is spring loaded against the chassis. It is widely known that in almost all thermal print mechanisms the platen roller is detachable from the thermal print mechanism in order to give access to the thermal paper roll reservoir, thus easing the loading and unloading of the paper roll.

One possible arrangement to reduce the size of the mechanism is to mount the thermal printhead directly onto the chassis. The distance between the back side of the mechanism to the paper inlet position defines the thickness of the thermal print mechanism, and it is a critical compactness characteristic. Here and below in the text "back side" means the side of the chassis that is reverse to the side where the thermal printhead is mounted. As in the most of the arrangements the motor is laid below the thermal printhead with its rotation shaft parallel to the thermal printhead dotline, the paper path has to go around the shape of the motor thus following an arc, increasing the mechanism thickness to at least the stepper motor diameter.

One way to reduce this thickness is to mount the motor vertically, out of the paper path. If the motor diameter is small enough this affects in a very minor way the overall width of the mechanism and allows having the thickness of the thermal print mechanism composed only by the thermal printhead plus the chassis thicknesses. In such arrangement the paper path becomes almost straight. Such arrangement is disclosed in the patent application EP15168283.8 with patent publication number EP 3095608 A1 (Compact platen roller motion system for thermal printing mechanism). FIG. 16 of said application, shows such an arrangement, wherein the paper path is completely flat. In this arrangement the pressure on the thermal paper is exerted by two lateral pressure means onto the platen roller, which are out of the paper path and because of this, the back side of the flat chassis gets bended and this leads to an arc deformation of the chassis, that lowers the pressure between the paper and the rubber of the platen roller in the central area, causing a pale printout in the middle of the thermal paper. The stiffness of the mechanism disclosed in document EP3095608A1 is not satisfying.

SUMMARY OF THE INVENTION

The aim of the present invention is to provide a thermal printer chassis with a reinforcing structure able to improve the stiffness of the central area of a thermal print mechanism, neither complicating its construction, nor increasing the manufacturing costs or its size.

The above-mentioned aim is achieved by a thermal printing mechanism according to the present invention that comprises:

- a printer chassis comprising first flat area for mounting a thermal printhead, comprising a dotline, the first flat area having two opposite ends parallel to the printhead dotline, a top end where the paper goes out of the printer chassis when printing and a bottom end where the paper enters the chassis when printing;
- said thermal printhead being fixedly mounted close to the top end of said first flat area of the printer chassis;
- a flexible circuit for electrically connecting the thermal printhead
- a motor for putting on rotation a platen roller;
- a platen roller to put into pressure the thermal paper against the thermal printhead dotline;
- two lateral pressure means to urge the platen roller against the printhead;
- at least one reinforcing element for the first flat area of the printer chassis, parallel to the thermal printhead dotline.

According to the present invention, at least one reinforcing element is arranged at the bottom end of the first flat area where the printer chassis has at least one fold forming a second flat area parallel to the first flat area of the printer chassis.

According to a preferred embodiment the reinforcing element comprises a U-shaped fold, so that the second flat area partially overlaps the first flat area of the printer chassis.

Advantageously in the above preferred embodiment the second flat area does not overlap an interconnection area of the thermal printhead with the flexible circuit cable.

Preferably the longitudinal gap created by the fold on one side and the thermal printhead on the other side is closed with closing material. Advantageously said closing material is made of resin material. According to a variant of the present invention the resin material covers also the interconnection area of the thermal printhead for connecting the flexible circuit cable.

According to another preferred embodiment the reinforcing element comprises two successive folds of the printer chassis wherein in each fold the printer chassis is folded at substantially right angle and wherein the second flat area is formed after second fold and does not overlap the first flat area.

Preferably the second flat area of the reinforcing element forms a paper guide.

Advantageously the printer chassis is made of a sheet metal.

Advantageously in the reinforcing element a longitudinal slot is provided as a passage for the flexible circuit cable. Preferably said longitudinal slot is closed on both ends with material of the printer chassis Preferably there is another reinforcing fold at the top end of the first flat area of the printer chassis where the thermal printhead is mounted.

The main advantage achieved by the present invention is to rigidify the central chassis structure of a flat thermal printing mechanism providing a very stable and uniform pressure distribution across the paper width and keeping its thickness minimal.

BRIEF DESCRIPTION OF THE DRAWINGS

The characteristics of the invention will be described in details in the following description of preferred embodiments, given as non-restrictive examples, with references to the attached drawings wherein:

FIG. 1 is an exploded view of the prior art, showing the assembly of the thermal printhead with the printer chassis and the paper guide;

FIG. 2 is a back view of the thermal print mechanism as per the prior art but with a back side protrusion in the printer chassis as per one possible but not optimal arrangement;

DETAILED DESCRIPTION OF PREFERRED EMBODIMENTS

Figure 3:
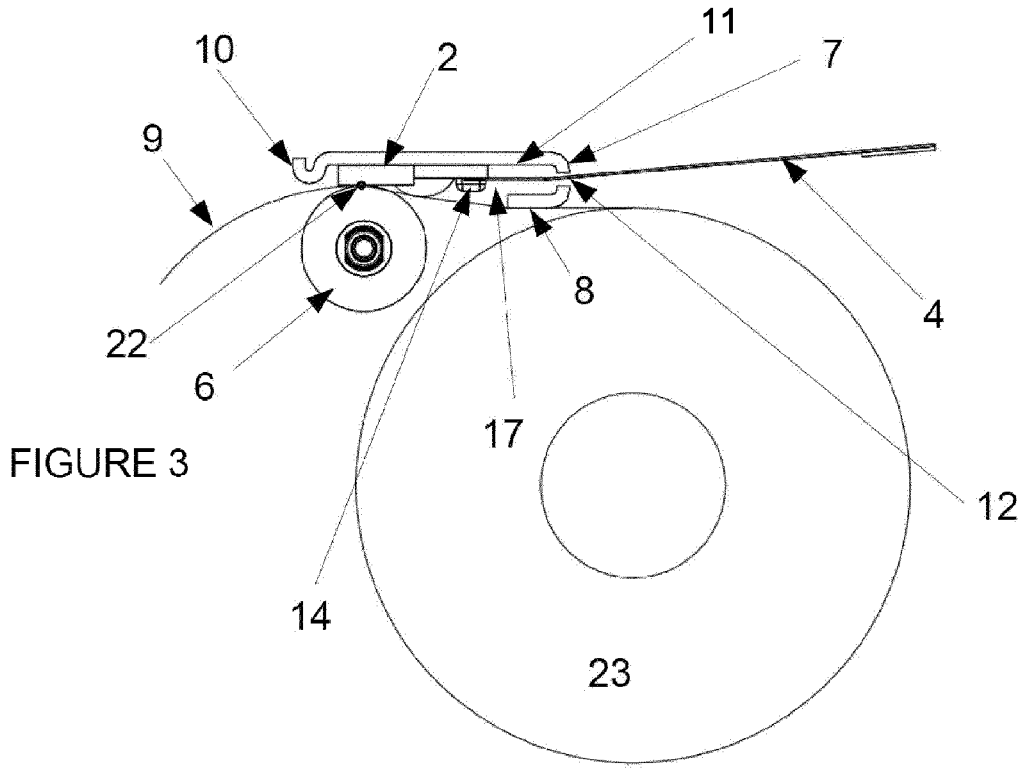
FIG. 3 is a section view of the thermal print mechanism in the area of the flexible circuit cable according to the present invention, including a paper roll.

As used in the present description and claims, the words "top", "bottom", "back", "left", "right" are not restrictive and reflect the position of the components of the thermal printer mechanism as shown on figures.

Thermal printing mechanism according to the present invention comprising a printer chassis 1, a thermal printhead 2, comprising a dotline 22, said thermal printhead 2 being fixedly mounted on the printer chassis 1, a platen roller 6 to put in pressure the thermal paper 9 against the thermal printhead dotline 22 of the thermal printhead 2, a flexible circuit cable 4 for electrically connecting the thermal printhead, a motor 16 for rotation of the platen roller and two lateral pressure means 18 to urge the platen roller 6 against the printhead 2.

FIG. 1 shows the prior art. A paper guide 3 is mounted on the chassis 1 having a width approximately same as the chassis 1. Both parts are mating each other and the assembly of these two parts is forming three different areas from left to right. The left area 19 supports the gear box and the motor 16, the left pressure means 18, and positions the left side of the platen roller 6. The central section is a first flat area 20 in order to minimize the back side thickness of the mechanism and provides a straight path for the paper. The third right area 21, holds the right pressure mean 18 and positions the right side of the platen roller 6.

The thermal printhead 2, on which the flexible circuit cable 4 is already assembled, is firstly mounted onto the inner part of said first flat area of the chassis and the paper guide is further assembled onto the central area of the chassis 1, thus sandwiching the thermal printhead between the first flat area of the chassis 1 and the paper guide 3.

Due to the lack of rigidity of the first flat area 20 of the chassis 1, when the pressure means 18 are urging the platen roller 6 against the thermal printhead 2, the first flat area 20 is bending and the pressure over the thermal paper is no more homogenous—with lower pressure in its central part compared to the edges. This results in a pale printout in the central area of the thermal paper.

To solve this problem, the rigidity of the first flat area 20 of the chassis 1 has to be significantly increased.

Therefore, several non-limiting options are possible, such as increasing the metal thickness, which leads to a back side thickness increase, or changing the metal material with a new one having higher Young's modulus and higher elasticity limit, but this will increase the manufacturing costs and the thickness as well.

Another option is to modify the shape of the back side of the chassis and keeping as much as possible the back side thickness unchanged. For example, a protrusion 5 can be provided at the back of the chassis as shown in FIG. 2. Obviously, this leads to a significant increase of the back side thickness of the mechanism only in a limited portion of the back surface which can be acceptable for some cases. And the higher the protrusion is, the more rigid the printer chassis becomes. To get a reasonable rigidity, the protrusion leads to a significant increase of the mechanism thickness.

Another option is to deform the back side of the chassis in the opposite direction, to the inner part of the print mechanism, while trying not to increase the mechanism thickness. This can be done on the top of the chassis as shown on FIG. 1 where a small fold 10 is provided on the top of the mechanism. Due to the very limited space available leading to a very small possible deformation of this fold, the stiffness improvement is very limited.

New arrangement according to the present invention is shown on FIG. 3, which is a cross section of the thermal print mechanism in the area of the flexible circuit cable.

The central part of the printer chassis 1 comprises a first flat area 20 where the thermal printhead 2 with a dotline 22 is mounted. Said first flat area 20 has two opposite ends substantially parallel to the printhead dotline 22, conditionally designated as top end 11 and bottom end 7. The thermal printhead 2 is fixedly mounted close to the top end 11 of the first flat area 20. A longitudinal reinforcing element is provided at the bottom end 7 of the first flat area 20 in the following way: the central part of the printer chassis 1 is extended in the direction of the bottom end and has at least one fold forming a second flat area 8 substantially parallel to the first flat area 20. The fold axis is parallel to the thermal printhead dotline 22.

This folded portion of the printer chassis strengthens the chassis and when the two lateral pressure means 18 push both extremities of the platen roller 6 thus bending the first flat area 20 of the chassis 1, provides a very strong resistance to such bending. Such arrangement increases in a drastic way the overall bending resistance of the first flat area 20 of the print mechanism without increasing the overall volume of the printer.

Figure 4:
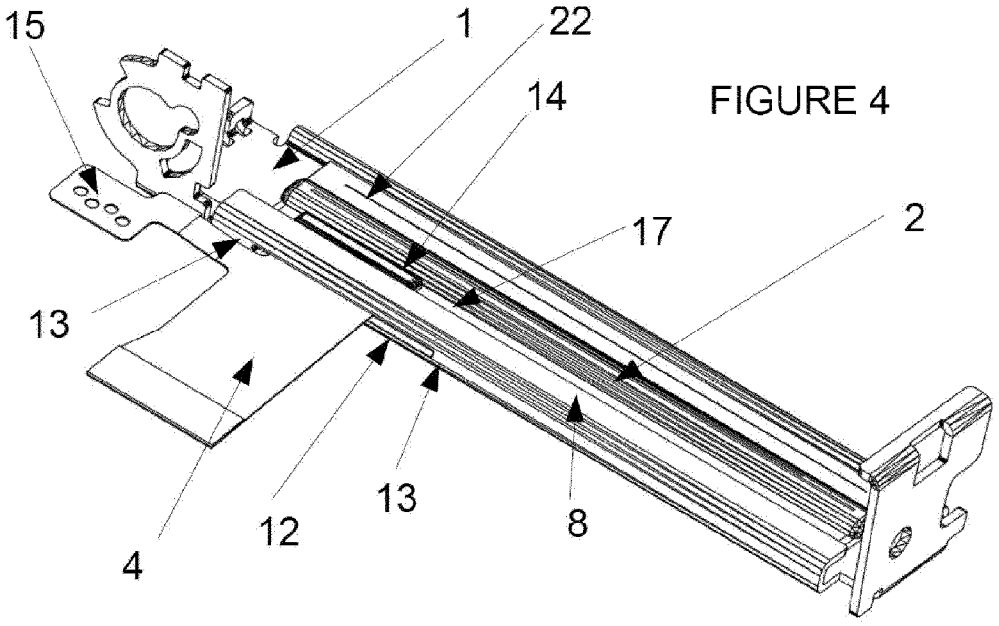
FIG. 4 is a schematic perspective view of the same arrangement as on FIG. 3.

In first embodiment of the invention as shown on FIGS. 3 and 4 the reinforcing element comprises a U-shaped fold where the printer chassis is folded on itself, so that the second flat area 8 partially overlaps the first flat area 20 of the printer chassis 1. In this embodiment the thickness of the printer chassis is not increased.

FIG. 4 shows the thermal print mechanism with the fixedly mounted thermal printhead 2 and the flexible circuit cable 4. The flexible circuit cable 4 is electrically connected both to the motor 16 through its arm 15 and to the thermal printhead 2. To this aim, the longitudinal slot 12 is arranged close to respective side of the printer chassis 1 where the motor 16 is mounted. It is important to have both sides 13 of the longitudinal slot 12 closed in order to keep the strong compression resistance of the first flat area 20 of the printer chassis 1.

If the flexible circuit cable 4 is already soldered on the thermal printhead 2, the flexible circuit cable 4 cannot be inserted through the longitudinal slot 12 of the printer chassis 1 from the top end 11 of the printer chassis. So the thermal printhead 2 has to be mounted first on the printer chassis 1 and then the flexible circuit cable 4 is inserted through the longitudinal slot 12 from the bottom end 7 of the printer chassis and then soldered to the thermal printhead 2.

The electrical connection of the flexible circuit cable 4 to the thermal printhead 2 is made with a soldering bar, and the space over the soldering area must be kept free. In the embodiment with U-shaped reinforcing element the above condition limits the length of the second flat area 8 in order not to overlap the interconnection area 14 where the flexible circuit cable is to be soldered, thus allowing the soldering bar to press the flexible circuit cable 4 against the thermal printhead 2 and solder it.

The gap 17, resulting from the U-shaped fold, has to be filled with some material in order to avoid dust to go inside the thermal printhead or any mechanical friction or stress or electrostatic discharge.

A first possible variant is to insert a plastic molded guide. Such long and thin part is very difficult to mold without getting a twisting effect. Moreover, due to the very little space available, insertion and fixing might be difficult.

A second preferred variant consists in filling this gap with a protective coating which can be a resin—bi-component or UV sensitive, given as non-limiting examples. As the interconnection area 14 where the flexible circuit cable is soldered to the thermal printhead must be protected to avoid oxidation and mechanical peeling this is usually achieved by using an UV protective resin. The same process can be used both to protect said soldered interconnection area 14 and to fill in the gap 17. This will result in extension of deposition time but on the other hand this step of the manufacturing process is very simple and automated.

Figure 6:
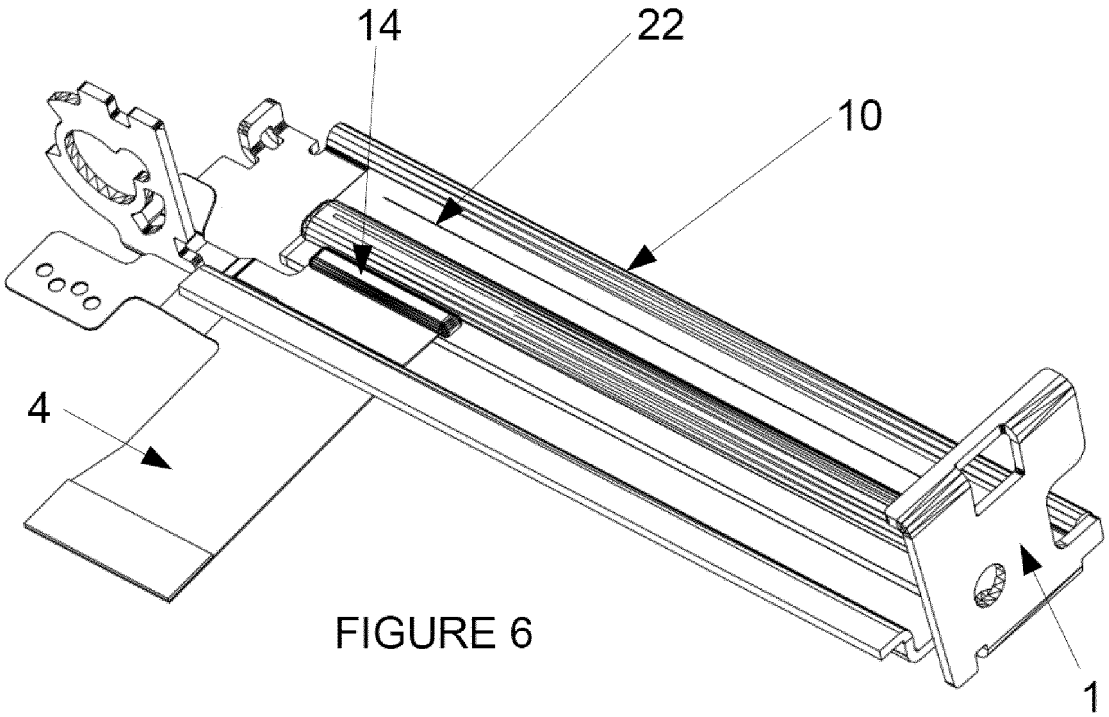
FIG. 6 is a schematic perspective of the present invention according one possible variant.
Figure 7:
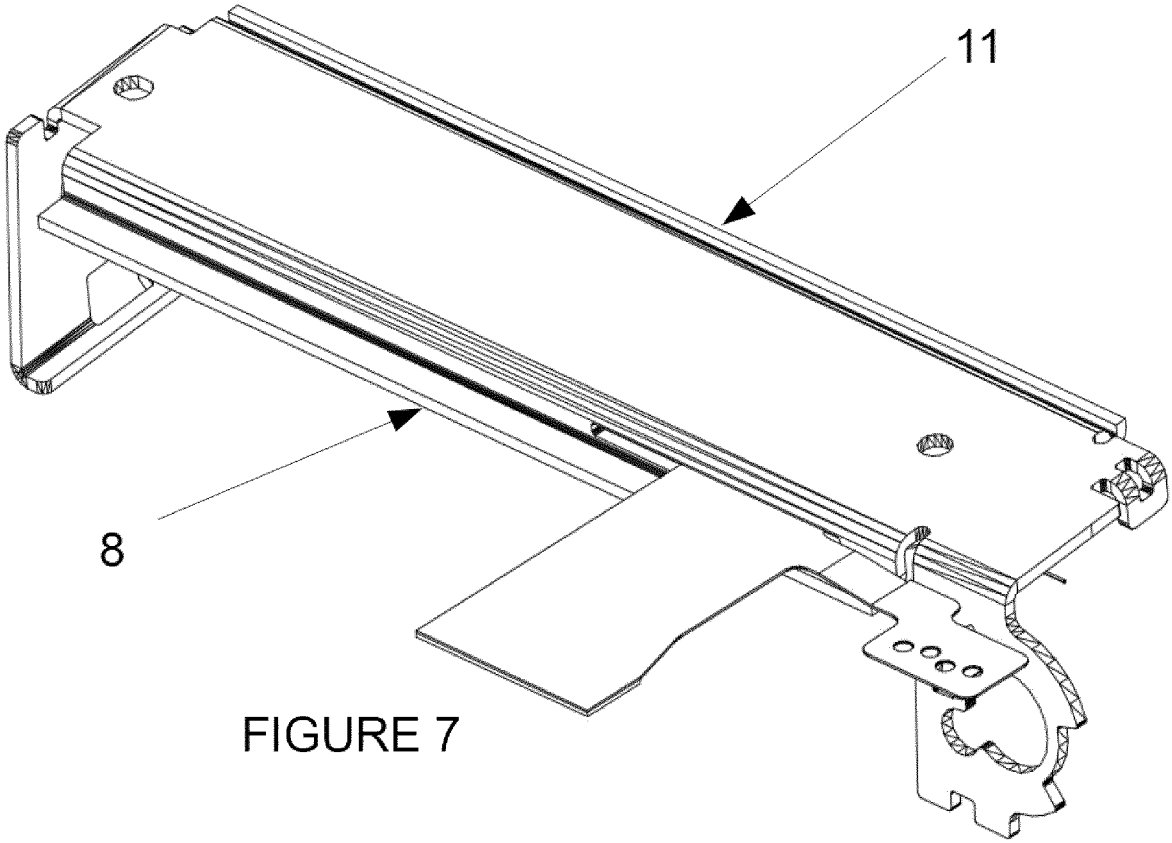
FIG. 7 is another schematic perspective of the present invention according to the same variant.

In second embodiment of the invention as shown on FIGS. 6 and 7 the reinforcing element comprises two successive folds of the printer chassis 1 wherein in each fold the printer chassis 1 is folded at a substantially right angle and wherein the second flat area 8 is formed after second fold and does not overlap the first flat area 20 thus increasing the distance from the top end 11 to the bottom end 7 of the printer chassis.

Preferably the second flat area 8 of the reinforcing element forms a paper guide.

Additional reinforcing element is optionally provided at the top end 11 of the first flat area 20. As shown on the FIGS. 3 and 4 said additional reinforcing element is in the form of a small longitudinal fold 10 of the printer chassis. The size (height and width) of the fold 10 is limited in order not to exit the printer chassis back surface and also not to interfere with the exit of the paper 9.

Figure 5:
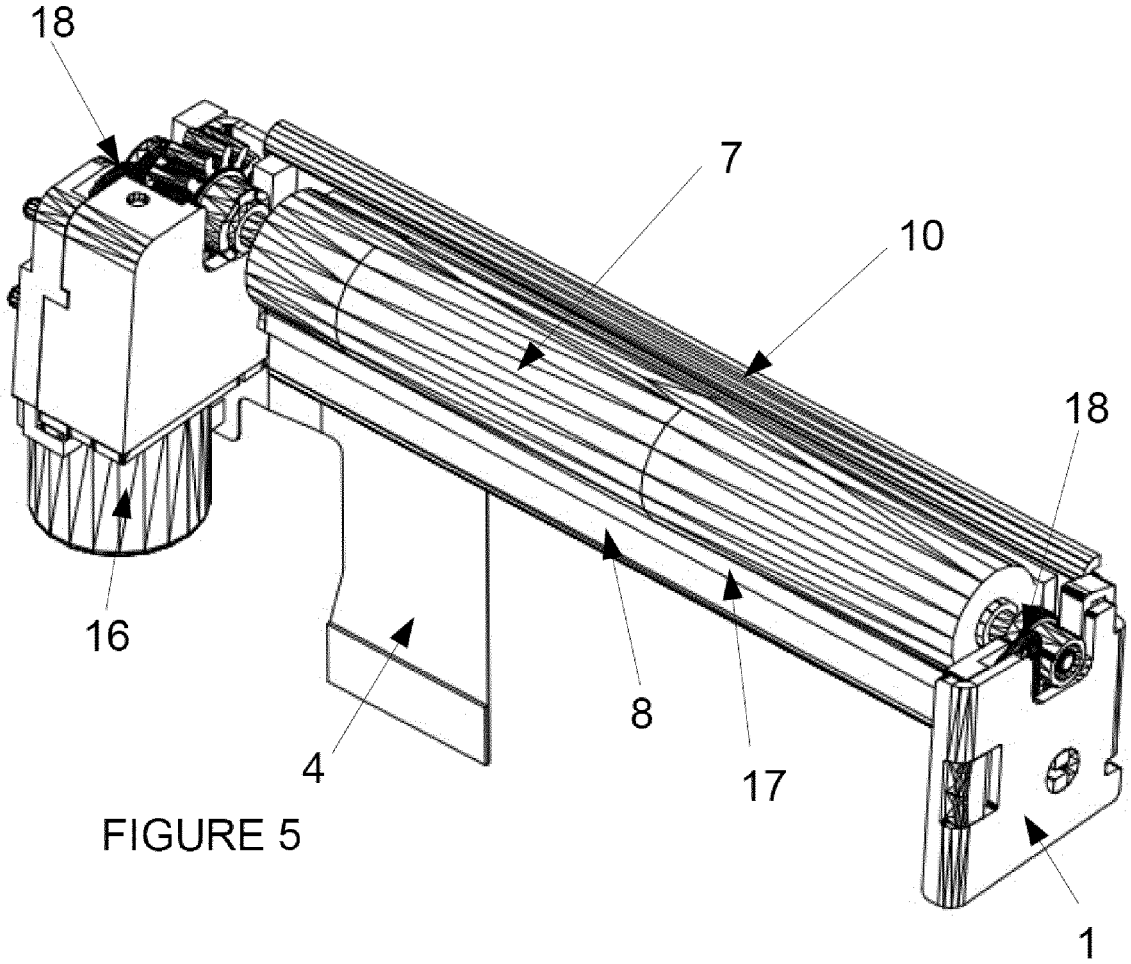
FIG. 5 is a schematic perspective view of the full thermal print mechanism according to the present invention.

FIG. 5 shows the print mechanism fully assembled where also the gap 17 is filled with one or the other of the proposed variants.

On FIG. 3, where the paper roll 23 is also represented, it can be seen that the thermal printer mechanism thickness is minimized, while the print mechanism stiffness is highly improved.

Various modifications and/or additions of parts will be apparent to those skilled in the art that will remain within the field and scope of the present invention defined in appended claims. All the part may further be replaced with other technically equivalent elements.

Reference signs for technical features are included in the claims for the sole purpose of increasing the ineligibility effect on the interpretation of each element identified by way of example by such reference signs.

The invention claimed is:

1. Thermal printing mechanism comprising:

a printer chassis, comprising a first flat area (20) for mounting of a thermal printhead, comprising a dotline (22), the first flat area (20) having two opposite ends parallel to the printhead dotline, a top end and a bottom end, said thermal printhead being fixedly mounted close to the top end of said first flat area of the printer chassis, a motor for putting in rotation a platen roller, a flexible circuit cable electrically connected to the thermal printhead, a platen roller to put in pressure thermal paper against the thermal printhead dotline, two lateral pressure means to urge the platen roller against the thermal printhead, at least one reinforcing element for the first flat area of the printer chassis, substantially parallel to the thermal printhead dotline, said at least one reinforcing element being arranged at the bottom end of the first flat area where the printer chassis has at least one fold forming a second flat area parallel to the first flat area.

2. The thermal print mechanism according to claim 1, wherein the reinforcing element comprises a U-shaped fold, so that the second flat area partially overlaps the first flat area of the printer chassis.

3. The thermal print mechanism according to claim 1, wherein the reinforcing element comprises two successive folds of the printer chassis wherein in each fold the printer chassis is folded at a substantially right angle and wherein the second flat area is formed after second fold and does not overlap the first flat area.

4. The thermal print mechanism according to claim 1, wherein the second flat area of the reinforcing element forms a paper guide.

5. The thermal print mechanism according to claim 1, wherein the printer chassis is made of a sheet metal.

6. The thermal print mechanism according to claim 1, wherein in the reinforcing element a longitudinal slot is provided as a passage for the flexible circuit cable.

7. The thermal print mechanism according to claim 6, wherein said longitudinal slot is closed on both sides with material of the printer chassis.

8. The thermal print mechanism according to claim 2, wherein the second flat area does not overlap an interconnection area of the thermal printhead with the flexible circuit cable.

9. The thermal print mechanism according to claim 8, wherein a longitudinal gap formed between second flat area and the thermal printhead is filled with closing material.

10. The thermal print mechanism according to claim 9, wherein the closing material is made of resin material.

11. The thermal print mechanism according to claim 10, wherein said resin material covers at least the interconnection area of the thermal printhead for connecting the flexible circuit cable.

12. The thermal print mechanism according to claim 1, further comprising another reinforcing fold at the top end of the first flat area of the printer chassis where the thermal printhead is mounted.

* * * * *